United States Patent [19]

Goodman

[11] 4,336,574

[45] Jun. 22, 1982

[54] LIGHTED COASTER FOR DRINKING GLASSES

[76] Inventor: Donald Goodman, 258 Roger Williams, Highland Park, Ill. 60035

[21] Appl. No.: 179,494

[22] Filed: Aug. 19, 1980

[51] Int. Cl.[3] ..... A47G 23/03; F21V 33/00

[52] U.S. Cl. ..... 362/101; 362/200; 248/346.1

[58] Field of Search ..... 215/100.5; 248/346.1; 362/101, 134, 200, 201; D7/45; 428/542

[56] References Cited

U.S. PATENT DOCUMENTS

| | | | |
|---|---|---|---|
| 2,532,181 | 11/1950 | Moore | 362/101 |
| 3,378,680 | 4/1968 | Moxley | 362/134 |
| 4,261,026 | 4/1981 | Bolha | 362/101 |

*Primary Examiner*—Henry F. Epstein
*Attorney, Agent, or Firm*—James J. Conlon

[57] ABSTRACT

A lighted coaster for supporting beverage containers such as glasses. The improvement provides a top cover having a translucent lens and a side skirt extending downwardly to overlap a base member. The base contains batteries and a spring-biased light bulb extending upwardly to contact the underside of the lens in such a fashion that when beverage glasses are placed on the coaster, the light moves downwardly to contact a suitably disposed circuit member and actuate the light. When the beverage is removed, the light urges the cover upwardly a short distance and breaks contact with the electric circuit and turns itself off.

11 Claims, 11 Drawing Figures

LIGHTED COASTER FOR DRINKING GLASSES

BACKGROUND OF THE INVENTION (1) Field of the Invention

This disclosure pertains to beverage support members such as coasters and in particular, to those devices containing a light source which provides an attractive, easily noticed coaster.

(2) Description of the Prior Art

While the prior art has disclosed a number of arrangements for providing tables which have lights to illuminate objects placed thereon, there is no known, illuminated, portable coaster device which contains a light source and batteries and a novel mechanism which turns the light on and off as beverages are placed on and removed from the coaster.

SUMMARY

This disclosure pertains to a lighted coaster for supporting beverages and in particular to a coaster having a spring biased, movable cover located above a base which contains a light and appropriate circuitry. The light is held in a cantilever contact member which also functions as a spring member.

In operation, as a beverage is placed upon a translucent lens of the cover member, the cover moves downwardly and the underside of the lens urges the light into contact with the appropriate circuitry which turns on the light. Light passes through the lens and provides a coaster which is easily noticed in a dark room. Conversely, when the beverage container is removed, a cantilevered spring which supports the light source urges the cover upwardly and breaks contact to turn off the light.

The electrical circuit members are stamped and formed into a configuration which fits easily into position upon mounting posts which extend upwardly from the bottom of the base. The posts could also be used to support non-stamped circuitry such as conventional wiring.

A modified version of the invention provides vane-type sides which mesh together, yet allow light to escape in an attractive manner.

It is an object of this disclosure to provide an improved beverage support coaster which contains a light source and a translucent or other appropriate type of cover that permits light to pass through and thus the coaster may be easily noticed in a dark room and is also an attractive member.

It is yet another object of this disclosure to provide a lighted beverage support having a cover and a base member which are interconnected by a suitable tab arrangement wherein the coaster member can be easily lifted without the base cover becoming separated.

Another object of this disclosure is to provide a lighted coaster having a base which contains circuitry which is easily formed and inserted onto upstanding post members located in the base to thereby provide a construction which is inexpensive to manufacture and assemble.

Yet another object of this disclosure is to provide a lighted coaster or beverage support having a cover and a base with side skirts which mesh together and allow light to pass therethrough without exposing the internal electrical apparatus.

Another object is to provide a two-piece, lighted coaster having a cover and base interconnected by a locking arrangement which allows limited vertical movement between the two members, yet keeps the cover and base securely connected.

These and other objects of the disclosure will become apparent to those having ordinary skill in the art with reference to the following drawings, description, and claims.

Figure 1:
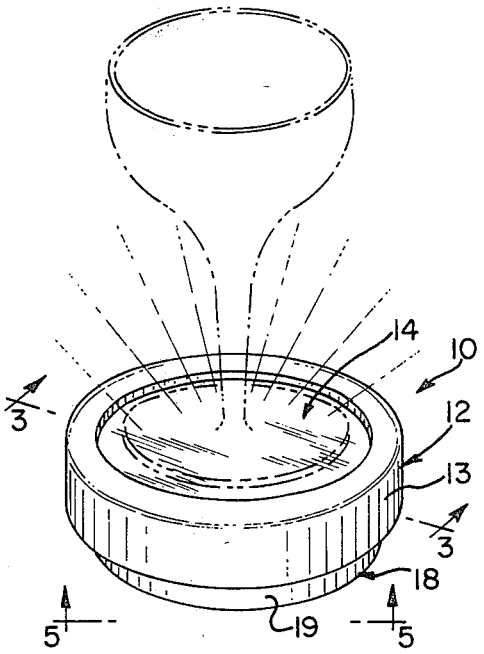
FIG. 1 is a pictorial illustration of the lighted coaster disclosed herein showing a beverage container in phantom located in position.
Figure 2:
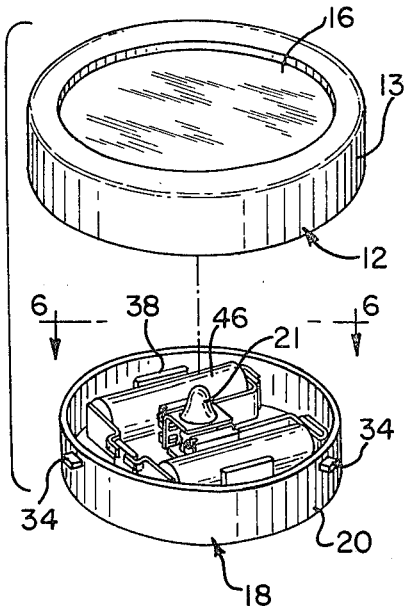
FIG. 2 is an exploded pictorial illustration of the device shown in FIG. 1.

Referring now to the drawings, and in particular, to FIG. 1, there is shown a lighted coaster designated generally by the numeral 10. The coaster 10 comprises a cover 12 having a downwardly depending skirt 13 and a top, article-supporting section providing a dish-shaped recess designated by the numeral 14. The dish portion 14 of the cover 12 also includes a lens 16 which is snapped into place and held by the knobs 17 which are spaced about the inner periphery of the cutout portion of the cover 12. Lens 16 is inserted from below and prevented from moving upwardly by rim of the dish portion 14. It is anticipated that the lens 16 be constructed of a impact resistant, translucent, frosted glass or plastic which will pass and diffuse light from below.

As shown in FIGS. 1-7, cover 12 is located about a cannister or base 18. The base 18 includes a solid bottom 19 having upstanding wall 20 encircling the bottom to provide a generally cylindrical shape. Light 21 is located centrally of the base 18 and is mounted within a cantilever-type light mounting metal tab 22. A so-called cantilever contact 24 is spaced below the bottom contact of the light 21, and as will be described later, when the cover 12 is depressed by weight of a beverage container, light 21 moves downwardly into contact with the cantilever contact tab 24 to complete the electrical circuit and activate the light 21. The remainder of the electrical circuitry and its mounting arrangement will be described shortly.

Figure 4:
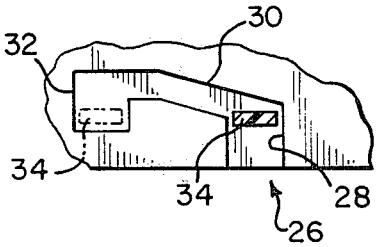
FIG. 4 is an enlarged, removed view showing the interconnecting and locking arrangement which joins the cover and base member.
Figure 3:
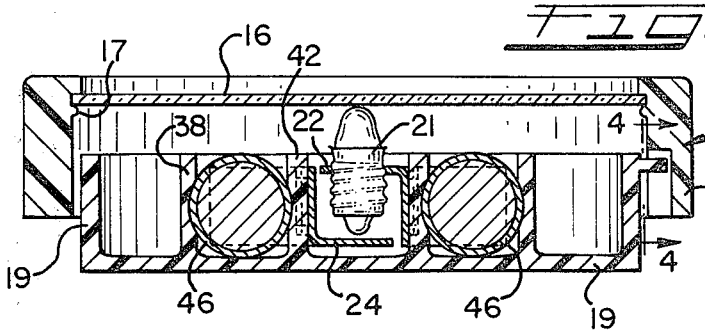
FIG. 3 is a sectional view taken generally along lines 3—3 of FIG. 1.
Figure 5:
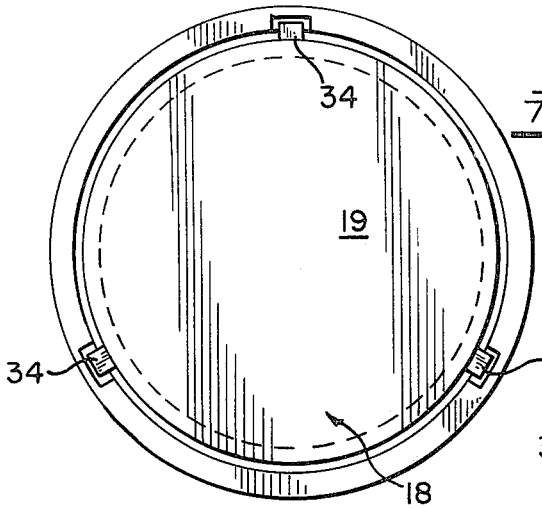
FIG. 5 is a bottom view taken generally along lines 5—5 of FIG. 1.
Figure 6:
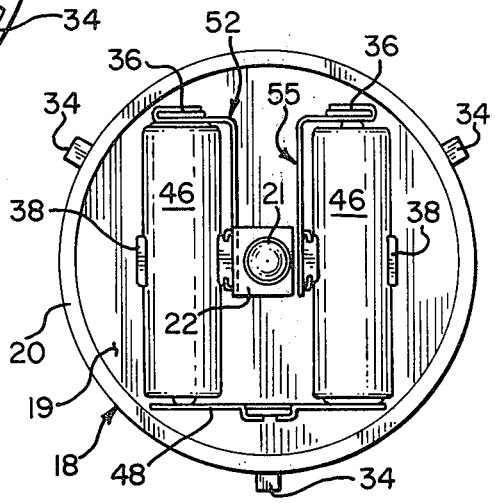
FIG. 6 is a view taken generally along lines 6—6 of FIG. 2.

As shown in FIG. 4, a locking slot and tab arrangement are provided and include a locking slot formed in cover 12 and designated generally by the number 26. An entrance opening 28 communicates with a tightening incline ramp section 30 which extends upwardly from the entrance 28 to a closed section 32. The locking slot arrangement is molded integrally with the cover 12. Base 18 includes at least three radially-extending fingers 34 extending outwardly from the walls 20 and adapted to coincide with the locking slots 26 located in the cover 12. Thus, when the cover 12 is aligned with the base 18, fingers 34 will initially enter the entrance portion 28 whereupon rotation of the cover 12 causes the inclined ramp section 30 to pass over the locking fingers 34 and thereby urge the cover 12 closer to the base 18 until the locking fingers 34 reach the closed section 32. When the locking fingers 34 enter the closed section 32, the biasing action produced by contact between the light bulb 21 and the underside of the lens 16 urges the cover 12 and the base 18 to separate. In such a configuration, the cover 12 is supported by the bulb 21 in a normally off or unlighted configuration.

Figure 7:
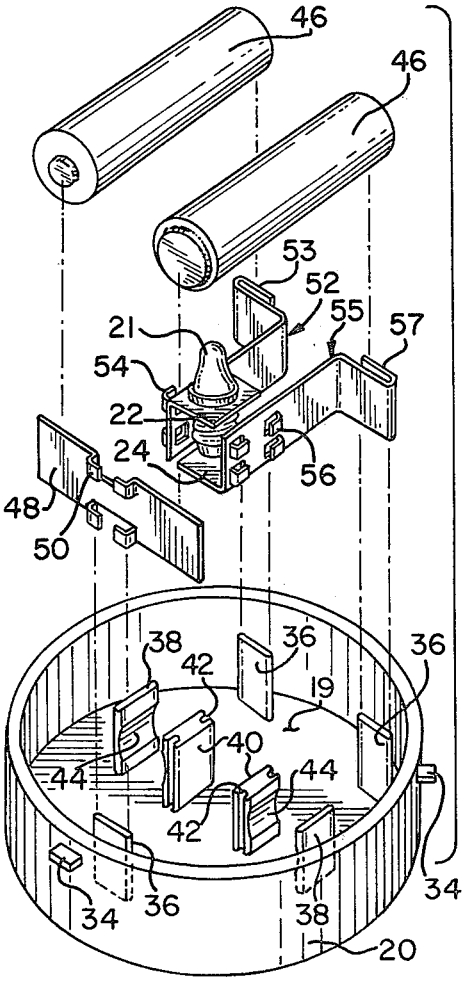
FIG. 7 is an exploded, pictorial illustration of the base and associated electrical apparatus.

As shown in FIG. 7, the base 18 includes a number of upstanding posts which are arranged and positioned to support circuit members and to support the batteries. Specifically, circuit posts are designated at 36 as shown in FIG. 7 and function exclusively to support metallic circuit members. Battery posts which are designated 38 and 40 and include a number of grooves 42 to receive circuit members. Battery posts 38, 40 also include contoured portions 44 to receive and retain the batteries. It is contemplated by this disclosure that two 1.5 volt so-called pen light AA batteries will be suitable for powering a lamp such as No. 245 manufactured by General Electrical Company or a light manufactured by Chicago Miniature Light (CML) No. 233 to provide illumination for this device. It is also contemplated that other suitable battery and light arrangements could be used including the so-called low power consuming light emitting diodes which may be used singly or in combination to provide the required illumination.

The circuitry involved with this disclosure provides a number of formed metallic clips which may be constructed of aluminum, tin plate or zinc coated steel so as to provide a reliable conducting circuit for the operation of the device. As shown in FIG. 7, a so-called base clip 48 extends across the base 18 in such a fashion as to contact both batteries 46. Base clip 48 includes integrally-formed tabs 50 which fit about the suitably exposed posts 36. Thus, when the tabs 50 are located about the posts 36, the base clip 48 will be securely held in place.

Similarly, a so-called light socket clip is designated by the numeral 52 and includes a mounting arm 53 having a reversely bent portion adapted to fit about the supporting posts 36. The light socket clip 52 also includes an attaching clip 54 which is integrally formed therein and adapted to fit onto the battery post 40 in the slots 42. As shown in the illustrations, a cantilever, light mounting tab 22 is integrally formed with the light socket clip 52 and may be threaded or extruded in a well known fashion so as to provide a socket or a formed threaded portion to receive light bulb 21. The cantilever tab 22 is also of such a length and thickness to provide the required biasing feature.

Base clip 55 is also located adjacent light 21 and includes the cantilever contact 24 which extends across the underside of the light 21, and, like cantilever tab 22, is of a suitable length and thickness to provide a required biasing force. Like the light socket clip 52, the base clip 55 also includes a reversely bent mounting arm 57 which is adapted to fit about posts 36 and which combine with the attaching clip 56 to hold the base clip 55 securely in position.

As shown by the foregoing, a glass-supporting lighted coaster is provided wherein a base-mounted light contacts the underside of a translucent lens 16 in such a fashion to hold the lens and cover 12 a distance above the bottom cannister 18 to keep light 21 in an off position when a beverage is not positioned on the coaster 10. When a glass is placed on the lens 16 of cover 12, the light 21 moves downwardly and completes contact with the cantilever contact 24, causing the light to glow. Light from the glowing lamp 21 illuminates the lens 16 and provides an attractive yet functional coaster which may be easily located in the dark and provides a visually attractive feature to any environment. Lens 16 may be white or colored as the decor requires.

Figure 8:
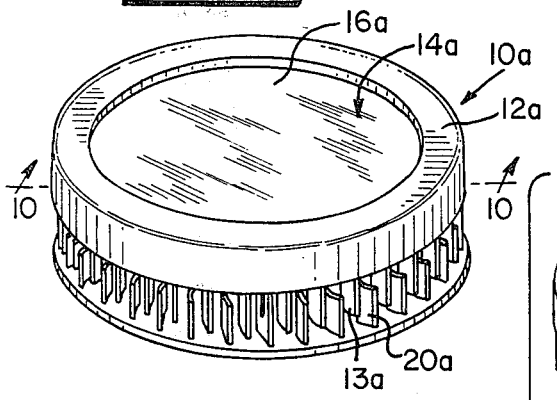
FIG. 8 is a pictorial illustration of a modified form of the device shown in FIG. 1.
Figure 9:
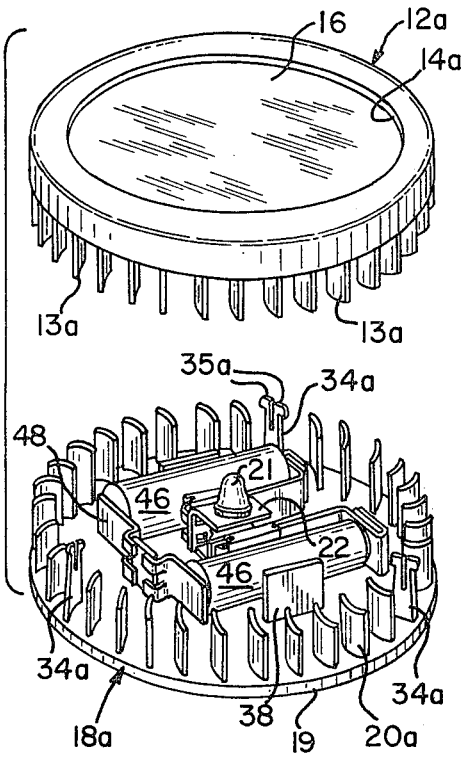
FIG. 9 is an exploded view with the cover and base separated and showing the device illustrated in FIG. 8.
Figure 11:
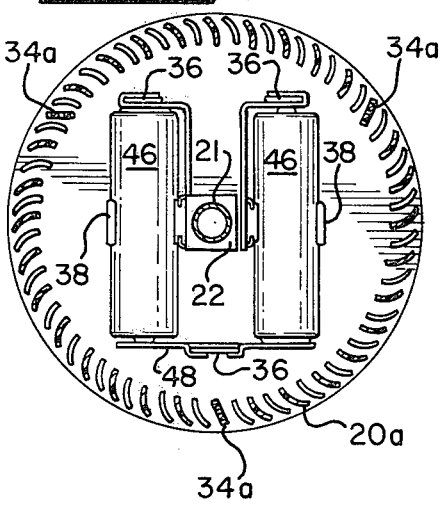
FIG. 11 is a view taken generally along lines 11—11 of FIG. 10.

Referring now to FIGS. 8–11, there is shown a modified form of the disclosure wherein parts similar to those already described are referred to with similar numbers with the suffix added. For example, as shown in FIG. 8, the lighted coaster is designated by the numeral **10*a* and includes a cover 12*a* having a dish-shaped portion 14*a* and a translucent lens 16*a* located in the dish-shaped portion 14*a*. Depending from the top of the cover 12 are a number of members 13*a*** which provide a vane-type effect.

Similarly, the base is designated **18*a* and includes a number of upstanding vane-type members 20*a*. Like the version shown in FIG. 1, base 18*a* includes a bottom 19*a* to which the vane-type members 20*a*** are integrally formed.

Figure 10:
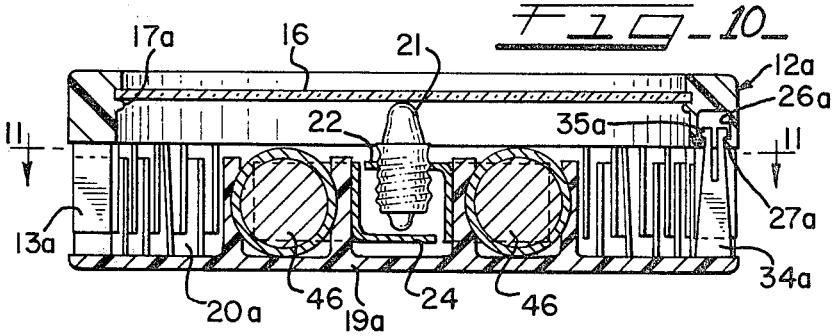
FIG. 10 is a sectional view taken generally along lines 10—10 of FIG. 8.

A number of modified fingers **34*a* extend upwardly from the bottom 19*a* and include locking tabs 35*a* which fit in locking openings 26*a* of the cover 12*a*. Once in position the locking tabs 35*a* are seated upon a locking edge which extends horizontally and is above the sloped inserting portion 27*a* as shown in FIG. 10 which assist in positioning the locking fingers 35*a* in the locking openings 26*a*. As shown in the illustrations, the locking openings 26*a* are deep enough to provide for relative movement of the cover 12*a*** and with respect to the base.

As illustrated by the description of the modified form of the invention, it is shown that by providing a vane-type of sides rather than continuous side as shown in FIG. 1, light generated inside the bottom **18*a* is allowed to diffuse outwardly through the vanes to provide an additional ornamental feature to the coaster 10*a***.

Like the other versions, the circuitry and supporting arrangement, shown in FIGS. 8–11, such as the posts 36 and 38 are the same as the arrangement shown in FIGS. 1–7.

From the foregoing, it can be seen that a novel and unobvious product is provided which provides for self-actuation of the electrical circuitry when a glass is placed on the coaster 10. The circuitry which supports the cantilever tab 21 also provides the biasing means for urging the cover 12 upwardly from the bottom from the cannister 18 to break the electrical connection and turn off the lamp 21 when the translucent lens 16 is unoccupied.

The foregoing description and drawings merely explain and illustrate the invention and the invention is not limited thereto, except insofar as the appended claims are so limited, as those who are skilled in the art and have the disclosure before them will be able to make modifications and variations therein without departing from the scope of the invention.

What is claimed is:

1. A lighted coaster for drinking glasses and adapted to be lighted when supporting a glass and be off when not supporting a glass, the improvement comprising:

a base;

light means positioned within the base;

current carrying first contact means supporting the light means and including first, movable connector means associated with the light means and movable between an off and on position;

second, electrical connector means located in alignment with the light means and spaced therefrom when the coaster is not supporting a glass;

a battery with circuit means connected with both the first movable connector means and the second connector means to power said light;

a cover;

said cover including a non permeable top providing a glass supporting lense means;

guide means interconnecting the base and cover and including locking means and means to allow limited relative vertical movement between the cover and base yet prevent the cover from being unintentionally removed from the base when lifted;

said first contact means providing biasing means for urging the first movable connector means to the off position away from the second connector means and thereby lift said cover when said glass is removed from the coaster.

2. The lighted coaster of claim 1 wherein:

said current carrying first contact means comprises a cantilevered spring providing means for encircling and mounting the light adjacent the underside of said cover.

3. The lighted coaster of claim 2 and said first contact means and said second electrical connector means including clip means having finger means for attaching the clip means to the base;

said clip means also including electrical contact means disposed to contact said battery.

4. The lighted coaster of claim 1 wherein said base includes:

circuit support post means adapted to cooperate with the finger means of the first and second electrical connector means for holding same in position within the base.

5. The lighted coaster of claim 1, wherein:

said second electrical connector comprises a second cantilevered contact located below the light.

6. The lighted coaster of claim 1 wherein said cover includes:

a removable, translucent lense;

retaining means for releasably holding the lense in position.

7. The lighted coaster of claim 1 wherein said guide means comprise;

slot means;

finger means;

said slot means having an entrance and a closed section adapted to receive and guide the finger means;

an inclined, ramp portion connecting the entrance and closed section;

said closed section having a height to permit vertical; relative movement between the base and cover.

8. The lighted coaster of claim 1, wherein said circuit means comprise:

formed metal means;

said formed metal means comprising battery terminal means, means for attaching the metal means to the base, and, cantilever means.

9. A lighted coaster adapted to be lighted when supporting a glass and unlighted when the glass is removed the improvement comprising:

a base;

a cover with a non permeable top adapted to receive and support a beverage container and having vane-type skirt means depending downwardly from the top and spaced apart a first distance;

said base having upstanding members corresponding with the vane-type skirt means and being spaced apart a second distance to permit the skirt means to fit between adjacent upstanding members;

a light;

battery means;

electrical means connecting the light and battery means;

said electrical means including spring means urging the cover away from the base and including means responsive to the weight of a beverage container on said cover to lower the cover and energize the light whereby light will pass through the openings at the side of the coaster.

10. The lighted coaster of claim 9, wherein said base and cover include:

fingers having cantilever locking tabs;

locking openings having a locking edge adapted to cooperate with the locking tabs for interconnecting and maintaining the base and cover in position as a unit.

11. The lighted coaster of claim 10 wherein:

said locking opening includes a restricted, smaller opening and a larger opening to permit limited vertical movement of the cover toward the base yet will maintain the interconnection between the cover and base when the cover is lifted.

* * * * *